US007175448B2

(12) United States Patent
Berning

(10) Patent No.: US 7,175,448 B2
(45) Date of Patent: Feb. 13, 2007

(54) COMPRESSOR HAVING A TERMINAL CLUSTER BLOCK WITH LOCKING END FITTINGS

(75) Inventor: Jeffrey L. Berning, Ft. Loramie, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 11/170,177

(22) Filed: Jun. 29, 2005

(65) Prior Publication Data

US 2007/0004263 A1 Jan. 4, 2007

(51) Int. Cl.
*H01R 13/44* (2006.01)

(52) U.S. Cl. ..... 439/127

(58) Field of Classification Search ..... 439/682, 439/127, 170, 680, 139, 271
See application file for complete search history.

(56) References Cited

U.S. PATENT DOCUMENTS

| | | | | |
|---|---|---|---|---|
| 3,766,513 A | | 10/1973 | Carre | |
| 3,885,849 A | | 5/1975 | Bailey et al. | |
| 4,158,473 A | | 6/1979 | Shearer | |
| 4,815,983 A | * | 3/1989 | Erickson et al. | 439/173 |
| 4,904,195 A | | 2/1990 | Thackeray | |
| 4,936,011 A | | 6/1990 | Berry et al. | |
| 5,096,432 A | * | 3/1992 | Cullen et al. | 439/139 |
| 5,109,602 A | | 5/1992 | Fukuda et al. | |
| 5,584,716 A | | 12/1996 | Bergman | |
| 5,683,260 A | * | 11/1997 | Kato et al. | 439/164 |
| 5,769,659 A | | 6/1998 | Ceylan | |
| 6,372,993 B1 | | 4/2002 | Eckels et al. | |
| 7,066,758 B2 | * | 6/2006 | Schwarz et al. | 439/333 |
| 2006/0040515 A1 | * | 2/2006 | Sanftleben | 439/34 |

* cited by examiner

*Primary Examiner*—Chandrika Prasad
(74) *Attorney, Agent, or Firm*—Harness, Dickey & Pierce, P.L.C.

(57) ABSTRACT

A connector block assembly has a connector block and a plurality of end fittings which are attached to at least one wire. Each end fitting is secured to the connector block by being inserted into the connector block and then being rotated to trap the end fitting within the connector pin. Once assembled onto a conductor pin, the conductor pin prohibits rotation of the end fitting with respect to the connector block and thus the disassembly of the end fitting from the connector block.

15 Claims, 4 Drawing Sheets

COMPRESSOR HAVING A TERMINAL CLUSTER BLOCK WITH LOCKING END FITTINGS

FIELD OF THE INVENTION

The present invention relates to an electrical terminal for the electrical connections for a hermetic compressor. More specifically, the present invention relates to an electrical terminal which includes an end wire fitting that rotates into position within the cluster block body. Assembly of the end fitting and the cluster block body onto the terminal pins prevents reverse rotation of the end wire fitting and thus the disassembly of the end fitting from the cluster block body.

BACKGROUND AND SUMMARY OF THE INVENTION

The utilization of hermetically sealed motor-compressor units has become increasingly prevalent in recent years in refrigeration applications where the motor-compressor units are employed to compress refrigerant vapor. The compressor is generally driven by an electric motor which rotates the crankshaft of the compressor at relatively high speeds. These hermetically sealed compressors are frequently located in environments where it becomes necessary to protect the connections of the electrical system and ensure that the integrity of the electrical connections is maintained. Typical electrical connections for a hermetically sealed compressor include power lines for providing electricity for operating the motor and control circuitry which monitors the operation of the compressor and which shut it down when an out of specification event is detected.

Typically one or more terminal assemblies are provided which allow electric power and/or electrical monitoring systems to extend through the shell of the compressor. The power supply terminal assemblies typically comprise a body member welded or otherwise secured to the shell of the compressor. The body member has a plurality of conductor pins which are secured to and extend through the shell such that one end of each conductor pin is located within the shell and the opposite end is located outside the shell. Electrical insulating and sealing material such as glass and/or epoxy potting forms a hermetic seal between each conductor pin and the body member. The internal end of each conductor pin is connected to the electrical leads of the motor. The external end of each conductor is connected to a suitable source of power.

In order to provide protection and sealing for the terminal assemblies, a terminal box is attached to the shell around the various terminal assemblies. The terminal box includes the appropriate cutouts to provide access to the various terminal assemblies and seals are provided around these cutouts in order to protect the terminal assemblies from the outside environment. Typically, an external connector block assembly is positioned over the power supply terminal assembly with this external connector block assembly being held in place by a cover which closes the terminal box. The external power is typically provided by a plurality of conductors which are attached to the external connector block assembly. Each of the plurality of conductors electrically engages a respective conductor pin when the external connector block assembly is assembled to the power supply terminal assembly. Once this connection is made, the terminal cover is attached to the terminal box to retain the external connector block assembly and isolate the electrical connections within the terminal box.

On the inside of the shell, an internal connector block assembly is positioned over the power supply terminal assembly. The internal connector block assembly routes electrical power from the power supply terminal assembly to the electric motor which drives the compressor. The internal connector block assembly includes a connector block and a plurality of connectors or end fittings which frictionally engage the conductor pins of the power supply terminal assembly.

One requirement for the internal connector block assembly is that its size be kept as small as possible so that it does not interfere with the other components of the compressor. When applications are encountered which require a higher current to be supplied to the motor, larger diameter conductor pins are required which in turn increase the size for the power supply terminal assembly, the external connector block assembly and the internal connector block assembly.

The present invention provides the art with an internal connector block assembly which minimizes the size of the internal connector block assembly to allow for the increase in diameter of conductor pins while still providing for a simple assembly and disassembly of the internal connector block assembly. The internal connector block assembly includes a connector body and a plurality of end fittings, each of which is attached to one or more respective wires. Each end fitting is assembled to the connector body by inserting and then rotating the end fitting to secure it within the connector body. Once assembled to the connector body, the internal connector block assembly is pushed onto the conductor pins of the power supply terminal assembly. The insertion of the conductor pin into the end fitting prohibits reverse rotation of the end fitting with respect to the connector block and thus the disassembly of the end fitting from the connector block. The present invention thus provides a low cost and minimum sized internal connector block assembly which is easily assembled to and disassembled from the power supply terminal assembly.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
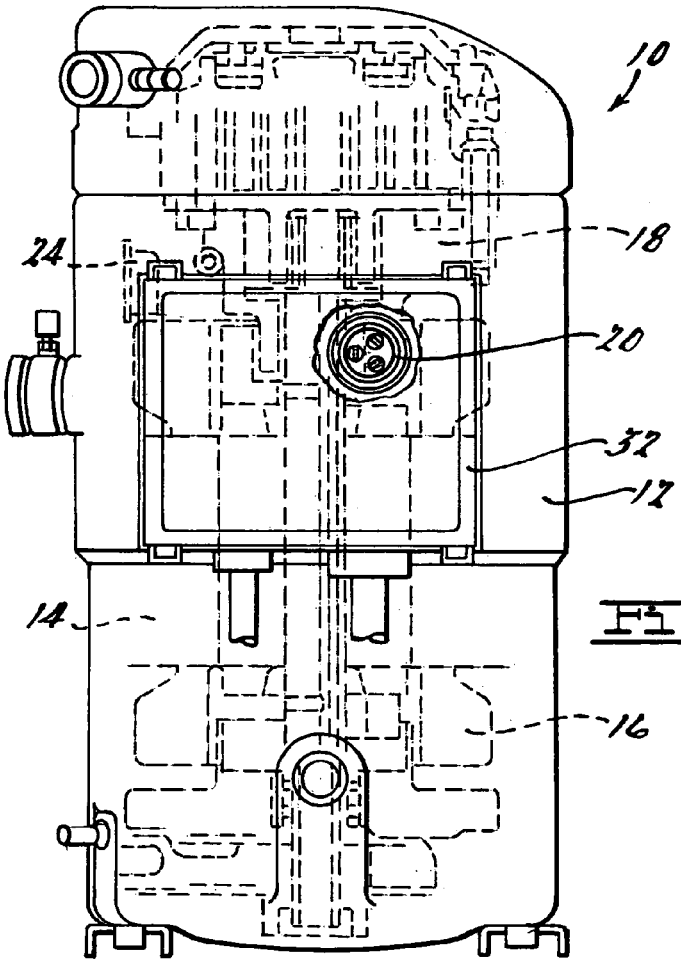
FIG. 1 is a side elevational view of a compressor assembly incorporating the unique internal connector block in accordance with the present invention.
Figure 2:
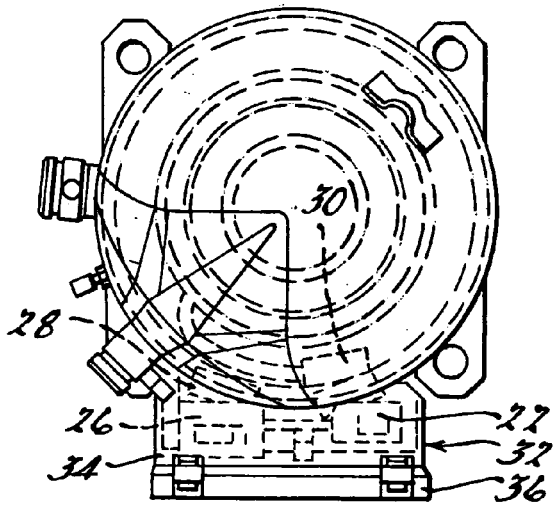
FIG. 2 is a top plan view of the compressor assembly shown in FIG. 1.
Figure 3:
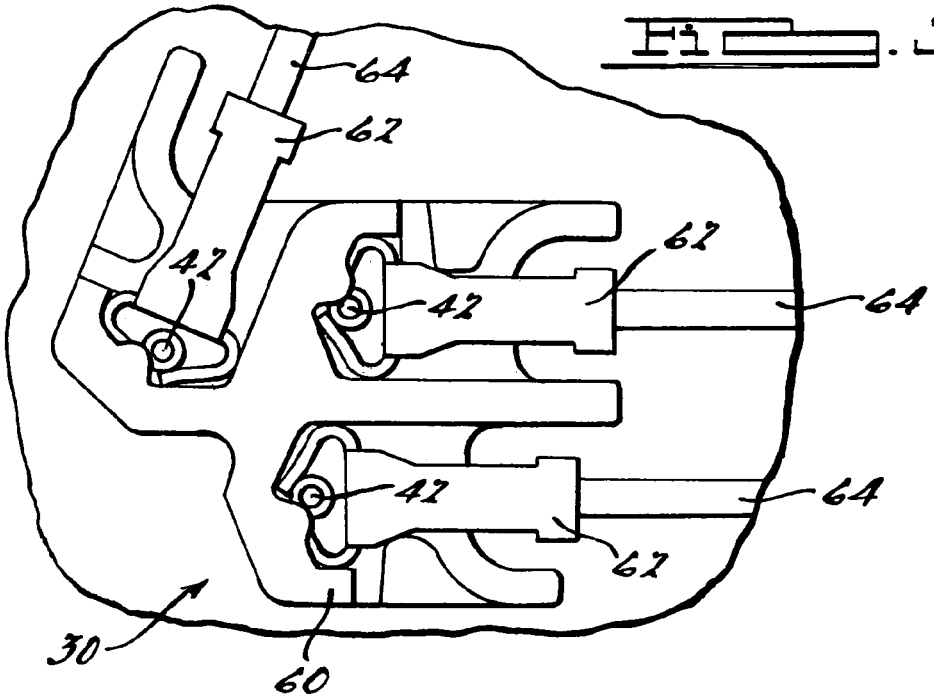
FIG. 3 is an enlarged plan view of the internal connector block shown in FIG. 1.
Figure 4:
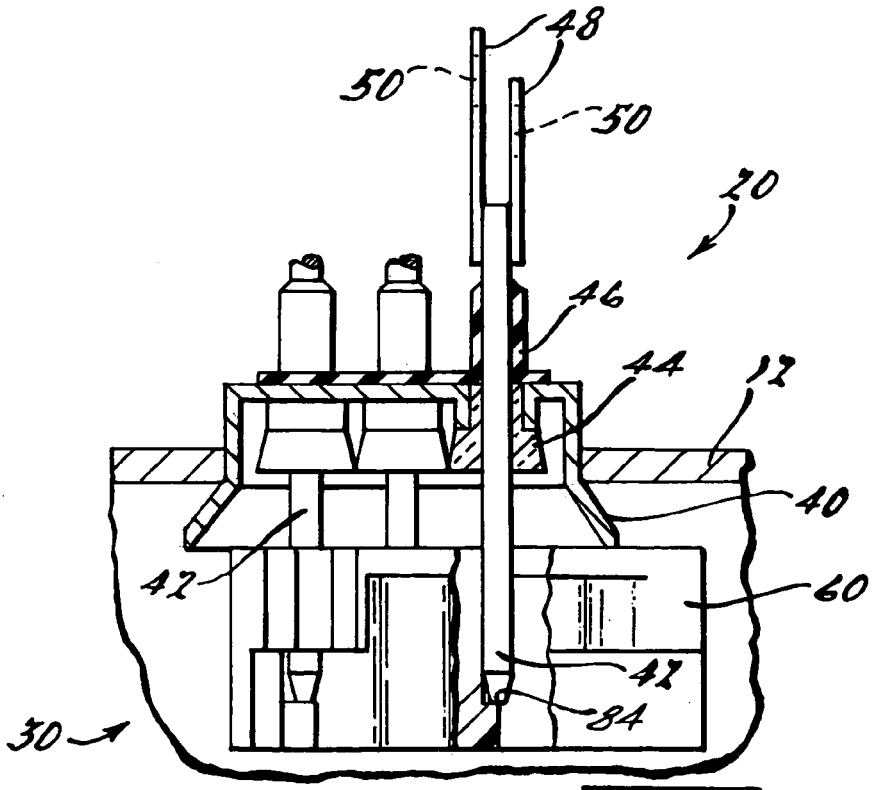
FIG. 4 is a cross-sectional view of the internal connector block and the compressor terminal assembly shown in FIGS. 1–3.
Figure 5:
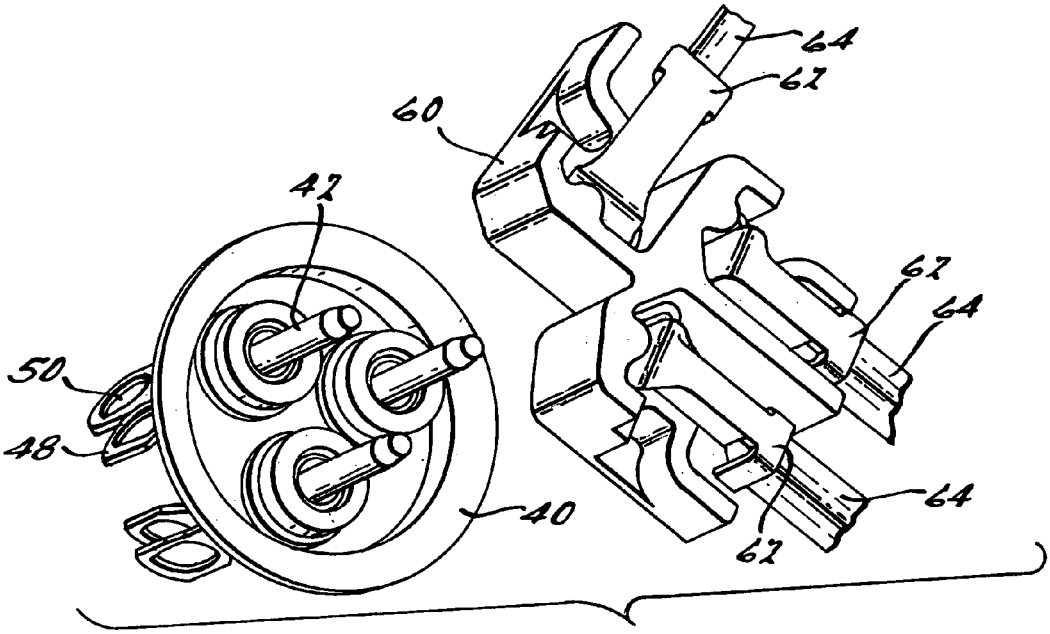
FIG. 5 is an exploded perspective view of the internal connector block and the compressor terminal assembly shown in FIGS. 1–4.
Figure 6:
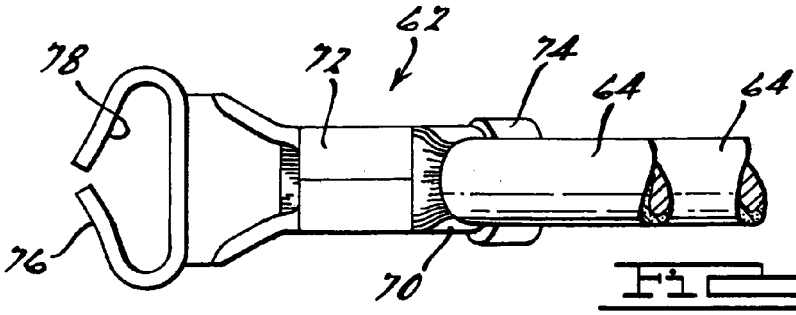
FIG. 6 is a top view of the end fitting shown in FIG. 5.
Figure 7:
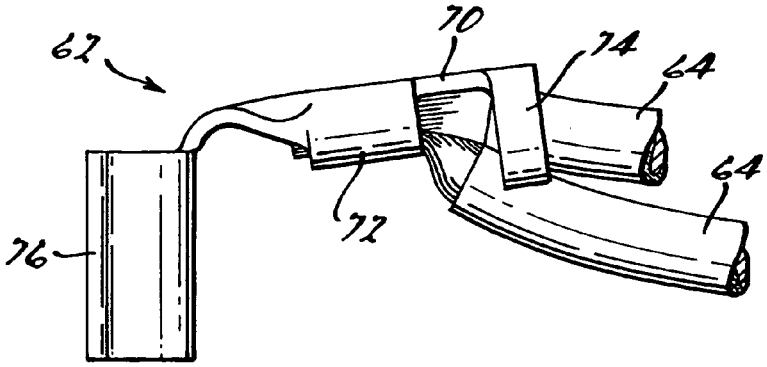
FIG. 7 is a side view of the end fitting shown in FIG. 6.
Figure 8:
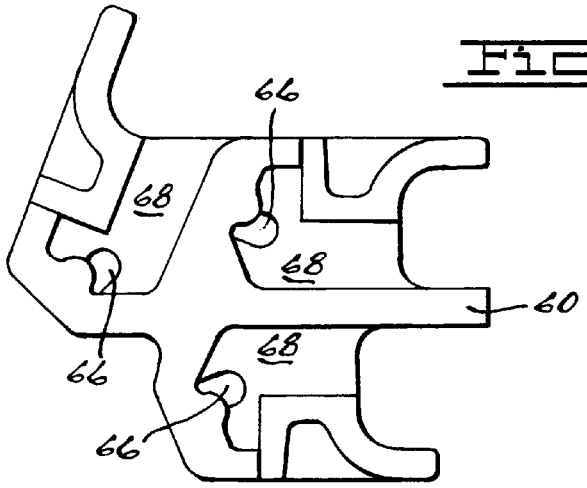
FIG. 8 is a top view of the internal connector block shown in FIG. 5.
Figure 9:
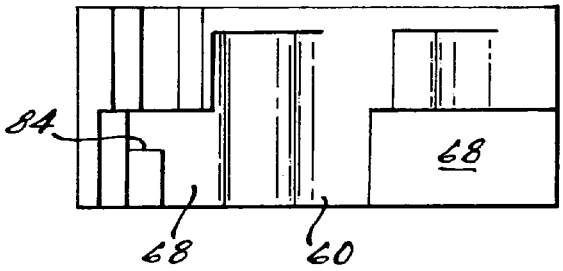
FIG. 9 is a side view of the internal connector block shown in FIG. 8.

Referring now to the drawings in which like reference numerals designate like or corresponding parts throughout the several views, there is illustrated in FIGS. 1–3, a hermetic compressor assembly which is designated generally by the reference numeral 10. Compressor assembly 10 can be a scroll compressor, a piston compressor, a screw compressor, or any other type of compressor known in the art. Compressor assembly 10 comprises a hermetic shell 12 which defines a sealed chamber 14 within which an electric motor 16 and a compressor 18 are disposed. For exemplary purposes, compressor 18 is depicted as a scroll compressor but it is to be understood that the present invention is not limited to a scroll compressor and can be utilized with any other type of machinery powered by an electric motor. Compressor assembly 10 further comprises a terminal assembly 20 extending through hermetic shell 12. Terminal assembly 20 is sealingly secured to hermetic shell 12 and it provides for the electrical connection between an external source of power (not shown) and electric motor 16 disposed within sealed chamber 14. An external terminal connector block assembly 22 interfaces between terminal assembly 20 outside of hermetic shell 12 and wiring from an external source of power as is well known in the art. A motor/compressor temperature protection system 24 is disposed within sealed chamber 14 and it is in electrical communication with a protection module 26 which is located outside of sealed chamber 14 and hermetic shell 12. Protection module 26 is in communication with temperature protection system 24 through a terminal connector 28. Protection module 26 is also in communication with the appropriate control circuitry as is well know in the art. An internal terminal connector block assembly 30 interfaces between terminal assembly 20 inside of hermetic shell 12 and electric motor 16.

A terminal box 32 is fixedly secured to hermetic shell 12 in order to house and isolate terminal assembly 20, protection module 26, terminal connector 28 as well as the electrical connections between terminal assembly 20 and external connector block assembly 22 and the electrical connections between temperature protection system 24, protection module 26 and its associated wiring. Terminal box 32 comprises a generally rectangular box shaped body 34 and a cover 36.

Referring now to FIGS. 3 through 9, terminal assembly 20 comprises a generally circular body 40 welded to hermetic shell 12. A plurality of conductor pins 42 (three in the illustrated embodiment extend through circular body 40. An insulator 44 is disposed between each conductor pin 42 and circular body 40 and an elastomeric gasket 46 is positioned over all of the plurality of conductor pins 42 on the exterior side of hermetic shell 12. One or more connecting terminals 48 are connected to each conductor pin 42 and each terminal 48 defines a through hole 50 for attachment with external terminal connector block assembly 22 as is well know in the art.

Internal terminal connector block assembly 30 comprises a non-metallic body 60, a plurality of end fittings 62 and a plurality of wires 64 which electrically communicate with the various windings associated with electric motor 16. Non-metallic body 60 is preferably manufactured from phenolic resin and it defines a plurality of through holes 66 equal in number to the number of conductor pins 42 of terminal assembly 20. The pattern for holes 66 corresponds with the pattern for conductor pins 42 and each conductor pin 42 is inserted through a respective hole 66 when internal connector block 30 is assembled to terminal assembly 20. Each hole 66 is disposed within a cut-out region 68 which is shaped to accept and allow rotation of a respective end fitting 62 as detailed below.

Each end fitting 62 is a generally L-shaped fitting manufactured from a conductive material which preferably is steel. One leg 70 of end fitting 62 is designed to be crimped onto one or more wires 64. A first crimping section 72 is designed to be crimped onto a stripped portion of wire 64 in order to provide electrical communication between the conductive portion of wire 64 and end fitting 62. A second crimping section 74 is designed to be crimped onto the exterior of wire 64 to act as a method of securing end fitting 62 to wire 64 eliminating the need to use only the first crimping section 72 as the securing mechanism. The other leg 76 of end fitting 62 is formed into a generally triangular shape to define an aperture 78 such that leg 76 deflects to frictionally receive and retain a respective conductor pin 42 to provide electrical communication between end fitting 62 and the respective conductor pin 42 and retain internal connector block assembly 30 onto terminal assembly 20.

Figure 10B:
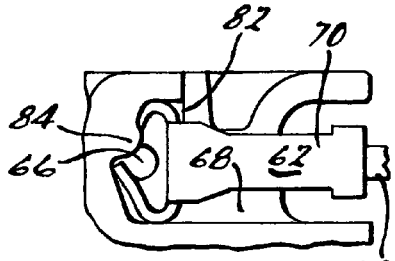
FIG. 10B is an enlarged view similar to FIG. 10A but with the end fitting rotated into position.
Figure 10A:
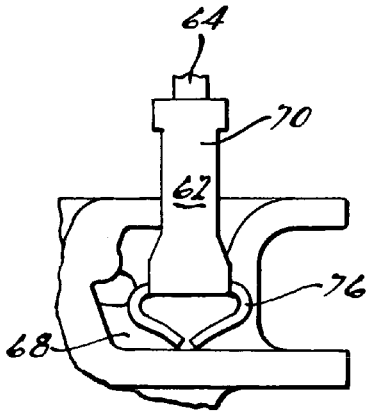
FIG. 10A is an enlarged view of one of the end fittings assembled to the internal connector block prior to rotation.
Figure 10C:
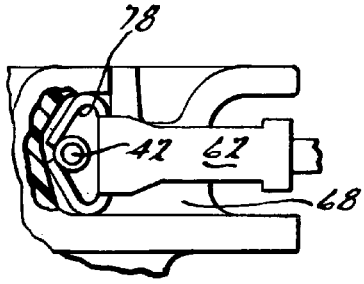
FIG. 10C is an enlarged view similar to FIG. 10B but after insertion of the conductor pin from the compressor terminal assembly.

Each cutout region 68 is designed to accept a respective end fitting 62 and to allow rotation of end fitting 62 within cutout region 68 to trap and thus secure end fitting 62 within cutout region 68. Referring to FIGS. 10A–10C, the assembly of end fitting 62 into cutout region 68 of non-metallic body 60 and the subsequent assembly of internal connector block assembly 30 to terminal assembly 20 is illustrated.

Initially, as shown in FIG. 10A, end fitting 62, with the appropriate wire or wires 64 attached, is placed within cutout region 68 such that leg 76 of end fitting 62 is disposed within cutout region 68 and that leg 70 of end fitting 62 extends generally perpendicular to the longitudinal direction of cutout region 68. Once end fitting 62 is positioned as shown in FIG. 10A, end fitting 62 is rotated approximately 90° to the position shown in FIG. 10B. The rotation of end fitting 10B can be clockwise or counter-clockwise depending on the design of cutout region 68.

As shown in FIG. 10B, when end fitting 62 is rotated approximately 90°, leg 70 of end fitting 62 extends generally parallel to the longitudinal direction of cutout region 68. When end fitting 62 is rotated to the position shown in FIG. 10B, a first stop 82 engages leg 76 to prohibit end fitting 62 from moving out of cutout region 68 in a direction generally parallel to the longitudinal direction of cutout region 68 and a second stop 84 engages leg 76 to prohibit end fitting 62 from moving out of cutout region 68 in a direction generally perpendicular to the longitudinal direction of cutout region 68. Thus, end fitting 62 is held within cutout region 68 with the rotation of end fitting 62 being the only method for removing end fitting 62 from cutout region 68. As illustrated in FIGS. 10A–10B, the rotation of end fitting 62 causes one arm of leg 76 of end fitting 62 to pass over hole 66 such that aperture 78 is aligned with hole 66.

As shown in FIG. 10C, internal connector block assembly 30 is shown assembled to terminal assembly 20. When internal connector block assembly 30 is assembled to terminal assembly 20, a respective conductor pin 42 extends into each through hole 66 of non-metallic body 60 and into each aperture 78 of end fitting 62 to provide electrical communication between each end fitting 62 and its respective conductor pin 42. The insertion of conductor pin 42 into aperture 78 of end fitting 62 prohibits rotation of end fitting 62 within cutout region 68 of non-metallic body 60 and thus prohibits the removal of end fitting 62 from non-metallic body 60 while it is assembled to terminal-assembly 20. With conductor pin 42 being disposed within aperture 78 of leg 76, rotation of end fitting 62 is prohibited because the one arm of leg 76 that passed over hole 66 during rotation of end fitting 62 is prohibited from passing back over hole 66 due to conductor pin 42 extending through hole 66 and into aperture 78.

When internal connector block assembly 30 is assembled to terminal assembly 20, conductor pins 42 are inserted into through holes 66 and apertures 78 and internal connector block assembly 30 is pushed onto conductor pins 42 until conductor pins 42 hits second stop 84. Second stop 84 controls the end position of internal connector block assembly with respect to terminal assembly such that internal connector block assembly does not contact or bottom out against any of insulators 44 which insulate conductor pins 42 from circular body 40.

Thus, the present invention provides internal connector block assembly 30 which is low in cost and which provides a simple disassembly from terminal assembly 20 when necessary but which also securely maintains the assembly with terminal assembly 20 during operation of compressor assembly 10. Non-metallic body 60 of internal connector block assembly 30 is a relatively simple component which can easily be manufactured by injection molding or the like without the need of incorporating extra slides or other high cost additions of the manufacturing equipment for non-metallic body 60.

Another advantage to internal connector block assembly 30 is that it allows for the increase in size of conductor pins 42 while maintaining the position of internal connector block assembly 30 close to hermetic shell 12 and thus out of the way of the remainder of the components of compressor assembly 10. When higher current applications are required, a larger diameter conductor pin 42 is required which in turn increases the size of both the internal and the external connector block assemblies. While this may or may not become a problem with the external conductor block assembly, the increase in size for the internal conductor block assembly encroaches upon the space required for the other components within the shell. Internal connector block assembly 30 provides for the increase in size of conductor pins 42 while minimizing any encroachment into the shell and while also maintaining a low cost for internal connector block assembly 30.

While the present invention has been described as being associated with internal connector block assembly 30, external terminal connector block assembly 22 can also include the features of the present invention, if desired.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A compressor assembly comprising:

a shell;

a compressor disposed within said shell;

an electric motor disposed within said shell for driving said compressor;

a terminal assembly extending through said shell, said terminal assembly including a conductor pin;

a connector block assembly attached to said terminal assembly, said connector block assembly comprising:

a connector block;

an end fitting releasably secured to said connector block, said end fitting being rotatable with respect to said connector block between a first position where said end fitting is not retained by said connector block and a second position where said end fitting is retained by said connector block, said end fitting defining an aperture which receives said conductor pin of said terminal assembly, wherein rotation of said end fitting with respect to said connector block is prohibited when said conductor pin is disposed within said aperture.

2. The compressor assembly according to claim 1 wherein said connector block assembly is disposed within said shell.

3. The compressor assembly according to claim 1 wherein said connector block defines a first stop for retaining said end fitting.

4. The compressor assembly according to claim 3 wherein said conductor pin engages said first stop to position said connector block assembly with respect to said terminal assembly.

5. The compressor assembly according to claim 4 wherein said connector block defines a second stop for retaining said end fitting.

6. The compressor assembly according to claim 3 wherein said connector block defines a second stop for retaining said end fitting.

7. The compressor assembly according to claim 1 wherein said connector block defines a stop, said conductor pin engaging said stop to position said connector block assembly with respect to said terminal assembly.

8. The compressor assembly according to claim 1 wherein said connector block assembly further comprises at least one wire attached to said end fitting.

9. The compressor assembly according to claim 8 wherein said connector block assembly is disposed within said shell and said wire extends between said end fitting and said electric motor.

10. An electrical connector comprising:

a terminal assembly having a conductor pin;

a connector block defining a bore for receiving said conductor pin;

an end fitting releasably secured to said connector block, said end fitting being rotatable with respect to said connector block between a first position where said end fitting is not retained by said connector block and a second position where said end fitting is retained by said connector block, said end fitting defining an aperture which receives said conductor pin of said terminal assembly, wherein rotation of said end fitting with respect to said connector block is prohibited when said conductor pin is disposed within said aperture.

11. The compressor assembly according to claim 10 wherein said connector block defines a first stop for retaining said end fitting.

12. The compressor assembly according to claim 11 wherein said conductor pin engages said first stop to position said connector block assembly with respect to said terminal assembly.

13. The compressor assembly according to claim 12 wherein said connector block defines a second stop for retaining said end fitting.

14. The compressor assembly according to claim 11 wherein said connector block defines a second stop for retaining said end fitting.

15. The compressor assembly according to claim 10 wherein said connector block defines a stop, said conductor pin engaging said stop to position said connector block assembly with respect to said terminal assembly.

* * * * *